US006505585B1

(12) United States Patent
Machida et al.

(10) Patent No.: US 6,505,585 B1
(45) Date of Patent: Jan. 14, 2003

(54) APPARATUS AND METHOD FOR CONTROLLING VALVE TIMING OF AN ENGINE

(75) Inventors: Kenichi Machida, Atsugi (JP); Satoru Watanabe, Atsugi (JP); Osamu Fujita, Atsugi (JP)

(73) Assignee: Unisia Jecs Corporation, Kanagawa-ken (JP)

( * ) Notice: Subject to any disclaimer, the term of this patent is extended or adjusted under 35 U.S.C. 154(b) by 0 days.

(21) Appl. No.: 09/570,464

(22) Filed: May 12, 2000

(30) Foreign Application Priority Data

Jun. 4, 1999 (JP) ..... 11-158203
Jun. 4, 1999 (JP) ..... 11-158204

(51) Int. Cl.[7] ..... F01L 1/34

(52) U.S. Cl. ..... 123/90.17; 123/90.15; 123/90.16

(58) Field of Search ..... 123/90.15, 90.16, 123/90.17, 90.18

(56) References Cited

U.S. PATENT DOCUMENTS 5,537,961 A * 7/1996 Shigeru ..... 123/90.15
5,626,108 A * 5/1997 Kato ..... 123/90.15
5,957,095 A * 9/1999 Kako ..... 123/90.15
6,006,707 A * 12/1999 Ito ..... 123/90.15
6,006,708 A * 12/1999 Ken ..... 123/90.17
6,047,674 A * 4/2000 Kadowaki ..... 123/90.15

FOREIGN PATENT DOCUMENTS

JP 10-141022 5/1998
JP 10-231741 9/1998

* cited by examiner

*Primary Examiner*—Thomas Denion
*Assistant Examiner*—Jaime Corrigan
(74) *Attorney, Agent, or Firm*—McDermott, Will & Emery

(57) ABSTRACT

In a vane type valve timing control apparatus, when an amplitude of a rotation phase of a cam shaft with respect to a crank shaft is above a predetermined value, a target value for the rotation phase is forcibly changed to a maximum advance angle and a maximum delay angle, so that oil of an advance angle side hydraulic chamber and a delay angle side hydraulic chamber is discharged together with air.

28 Claims, 10 Drawing Sheets

APPARATUS AND METHOD FOR CONTROLLING VALVE TIMING OF AN ENGINE

BACKGROUND OF THE INVENTION (1) Field of the Invention

The present invention relates to an apparatus and method for controlling valve timing of an engine, constructed such that a rotation phase of a cam shaft with respect to a crank shaft is variably controlled continuously by oil pressure control using a valve.

(2) Description of the Related Art

Heretofore as an apparatus for controlling valve timing of an engine, there is a vane type valve timing control apparatus such as disclosed in Japanese Unexamined Patent Publication No. 10-141022.

With this apparatus, recess portions are formed on an inner peripheral face of a cylindrical housing secured to a cam sprocket, while vanes of an impeller secured to a cam shaft are accommodated in the recess portions, the construction being such that the cam shaft can rotate relatively with respect to the cam sprocket, within a range in which the vanes can move inside the recess portions.

Furthermore, the construction is such that by supplying and discharging oil pressure relatively with respect to a pair of hydraulic chambers (advance angle side hydraulic chamber and delay angle side hydraulic chamber) formed by the vanes partitioning the recess portions into front and rear in the rotation direction, the vanes are maintained at a central position of the recess portion, and continuously variable control of the rotation phase is performed. Moreover, the construction is such that once the oil pressure in the pair of hydraulic chambers has been adjusted to an oil pressure to give a target rotation phase, an oil pressure passage is closed by a valve so that the supply and discharge of oil pressure is stopped.

However, a positive and negative rotational torque (referred to hereunder as cam torque) is alternately generated in the cam shaft due to valve springs urging the intake and exhaust valves in the close direction, and when the oil pressure passage is closed by the valve so that the supply and discharge of oil is stopped, the oil pressure in the hydraulic chamber on the side to which the positive cam torque is applied increases.

Then, if oil leakage occurs due to the increase in oil pressure due to the cam torque, when the positive and negative of the can torque inverts, air is drawn in from the position where the oil leakage occurs so that air is mixed with the oil in the sealed hydraulic passage.

If a cam torque is applied in the condition with air mixed, since the compressibility of air is greater than that of oil, then when a positive cam torque is applied, the rotation phase is displaced further. Hence there is the possibility that with normal feedback control, convergence is not possible, and hunting of the rotation phase occurs.

SUMMARY OF THE INVENTION

The present invention takes into consideration the above problems with the object of providing a control apparatus and control method which can prevent beforehand excessive hunting of the rotation phase due to cam torque, and which can reliably converge hunting of the rotation phase due to cam torque.

In order to achieve the above objectives, the present invention is constructed so that supply and discharge of oil pressure in a hydraulic chamber is forcibly performed in preference to a control for making a rotation phase coincide with a target value. Due to this forcible supply and discharge of oil pressure, mixing of air inside the hydraulic passage is prevented and any mixed air is discharged.

The forcible supply and discharge of oil pressure to the hydraulic chamber may be performed by forcible offset of an oil pressure control signal, this forcible offset being performed in a condition with oil pressure maintained.

Furthermore, the offset amount in the offset of the control signal may be variably set based on a target value of the rotation phase, a temperature of the operating oil, rotation speed of the engine, or supply pressure of the operating oil.

On the other hand, the construction may be such that the forcible supply and discharge of oil pressure in the hydraulic chamber is performed when the amplitude of the rotation phase is above a predetermined value. The condition where the amplitude of the rotation phase is above a predetermined value may be judged from an actually measured rotation phase. Moreover, the construction may be such that a condition is judged where it is predicted that the amplitude of the rotation phase will reach above a predetermined value.

For the condition where it is predicted that the amplitude of the rotation phase will reach above a predetermined value, a condition where the temperature of the operating oil is above a predetermined temperature, or the oil pressure supplied to the hydraulic chamber is below a predetermined value may be judged.

The forcible supply and discharge of oil pressure when the amplitude of the rotation phase is above a predetermined value may be performed by forcibly changing the target value of the rotation phase.

In changing the target value, preferably the target value is changed to a maximum advance angle or a maximum delay angle. Furthermore, the construction is more preferable such that after changing to either one of the maximum advance angle side and the maximum delay angle side, changing is then to the other side.

Moreover, the forcible changing of the target value is preferably performed in a high load and high rotation speed region of the engine, or in a decelerating operating condition.

Other objects and aspects of the present invention will become apparent from the following description of embodiments, with reference to the appended drawings.

DETAILED DESCRIPTION OF THE PREFERRED EMBODIMENTS

Figure 1:
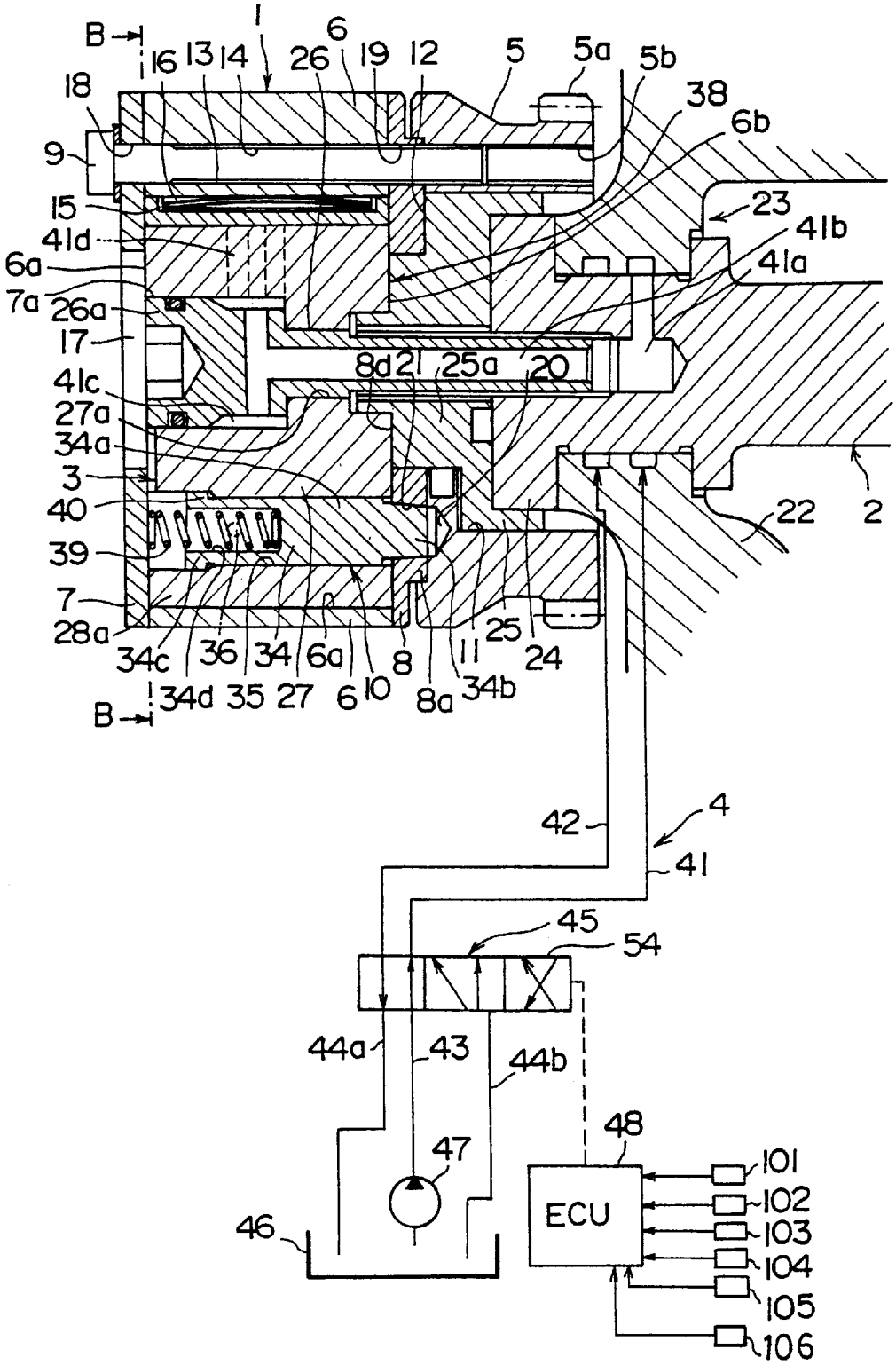
FIG. 1 is a cross-sectional view showing a variable valve timing mechanism according to an embodiment.
Figure 2:
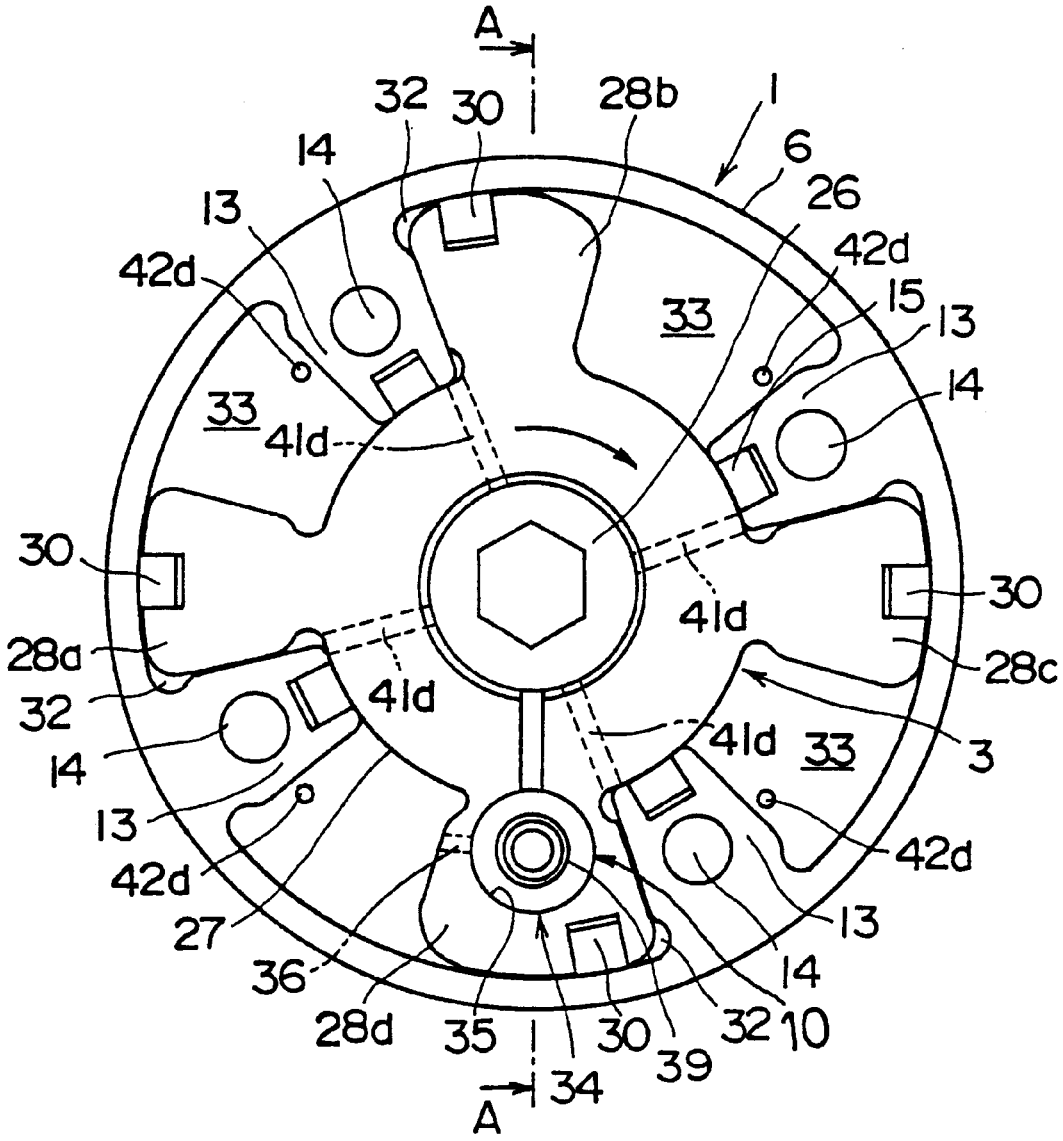
FIG. 2 is a sectional view on B—B of FIG. 1.
Figure 3:
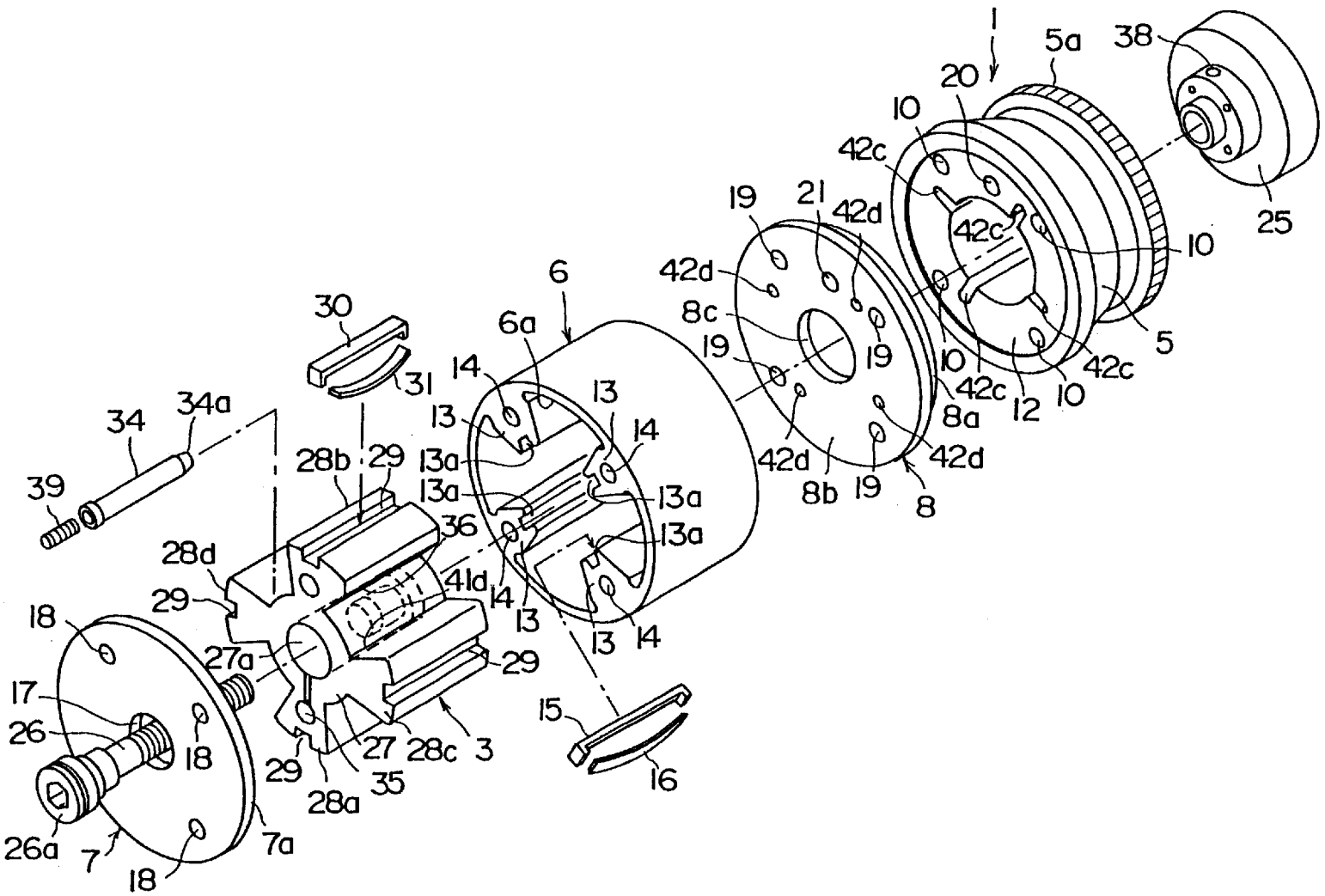
FIG. 3 is an exploded perspective view of the variable valve timing mechanism.

FIG. 1 through FIG. 6 show a variable valve timing mechanism of an engine according to an embodiment, showing this applied to an intake valve side.

The variable valve timing mechanism shown in the figures comprises: a cam sprocket 1 (timing sprocket) which is rotatably driven by an engine crank shaft (not shown in the figures) via a timing chain; a cam shaft 2 provided so as to be rotatable relative to the cam sprocket 1; a rotation member 3 secured to an end portion of the cam shaft 2 and accommodated inside the cam sprocket 1 so as to be freely rotatable; an hydraulic circuit 4 for relatively rotating the rotation member 3 with respect to the cam sprocket 1; and a lock mechanism 10 for selectively locking a relative rotation position between the cam sprocket 1 and the rotation member 3 at a predetermined position.

The cam sprocket 1 comprises: a rotation portion 5 having teeth 5*a*, an outer periphery of which engages with a timing chain (or timing belt); a housing 6 located forward of the rotation portion 5, in which the rotation member 3 is housed so as to be freely rotatable; a disc shape front cover 7 which closes off a front end opening of the housing 6 to form a cover; and an approximate disc shape rear cover 8 disposed between the housing 6 and the rotation portion 5 for closing off a rear end portion of the housing 6. The rotation portion 5, the housing 6, the front cover 7, and the rear cover 8 are connected together as one in the axial direction by means of four small diameter bolts 9.

The rotation portion 5 presents an approximate annular shape with four internally threaded holes 5*b* for threaded engagement with the respective small diameter bolts 9, bored through in the axial direction at evenly spaced positions at approximately 90° in the circumferential direction. A stepped diameter engaging bore 11 is formed at an internal central position of the rotation portion 5 for engaging with a later described sleeve 25 for making up a passage. Moreover, in a front end face of the rotation portion 5 is formed a disc shape engaging groove 12 for engaging with the rear cover 8.

Furthermore, the housing 6 presents a cylindrical shape formed with both front and rear ends open and with four partition portions 13 protrudingly provided at positions on the inner peripheral face at 90° in the circumferential direction. The partition portions 13 present a trapezoidal shape in transverse section, and are respectively provided along the axial direction of the housing 6. Each of the opposite end edges of the partition portions 13 are in the same plane as the opposite end edges of the housing 6, and on the base edge side are formed four bolt through holes 14 in the axial direction, through which the small diameter bolts 9 pass. Moreover, inside of retention grooves 13*a* formed as cut-outs along the axial direction in central positions on the inner edge faces of each partition 13 are engagingly retained C-shaped seal members 15 and plate springs 16 for urging the seal members 15 inward.

Furthermore, with the front cover 7, a central relatively large diameter bolt through hole 17 is formed therethrough, and four bolt holes 18 are drilled at positions corresponding to each of the bolt through holes 14 of the housing 6.

The rear cover 8 has a disc portion 8*a* on a rear face thereof, which is engagingly retained inside the engaging groove 12 of the rotation portion 5, and an aperture 8*c* formed at a central portion into which is inserted a small diameter annular portion 25*a* of the sleeve 25. Furthermore, four bolt holes 19 are similarly formed at positions corresponding to the bolt through holes 14.

The cam shaft 2 is rotatably supported on the upper end portion of a cylinder head 22 via cam bearings 23. Cams (omitted from the figures) which open the intake valves via valve lifters, are integrally provided at predetermined positions on the outer peripheral face of the cam shaft 2, and a flange portion 24 is integrally provided on the front end portion.

The rotation member 3 is secured to the front end portion of the cam shaft 2 by means of a fixing bolt 26 which passes in the axial direction through the sleeve 25 which has respective front and rear portions engaged with the flange portion 24 and the engaging bore 11. The rotation member 3 comprises an annular base portion 27 having a bolt hole 27*a* drilled through a central portion for taking the fixing bolt 26, and four vanes 28*a*, 28*b*, 28*c*, and 28*d* integrally provided on an outer peripheral face of the base portion 27 at 90° positions in the circumferential direction.

The first through fourth vanes 28*a*~28*d* present respective cross-sections of approximate trapezoidal shapes. The vanes are disposed in the recess portions between each partition portion 13 so as to form spaces in the recess portions to the front and rear in the rotation direction. Advance angle side hydraulic chambers 32 and delay angle side hydraulic chambers 33 are thus formed between the opposite sides of the vanes 28*a*~28*d* and the opposite side faces of the respective partition portions 13. Moreover, inside of respective retention grooves 29 cut out along the axial direction in the center of the outer peripheral faces of the respective vanes 28*a*~28*d* are engagingly retained C-shaped seal members 30 for contacting with inner peripheral faces 6*a* of the housing 6, and plate springs 31 for urging the seal members 30 outward.

The lock mechanism 10 comprises: an engaging groove 20 formed at a predetermined position on the outer peripheral side of the engaging groove 12 of the rotation portion 5; an engaging aperture 21 with a tapered inner peripheral face bored through the rear cover 8 at a predetermined position corresponding to the engaging groove 20; a slide bore 35 bored through one of the vanes 28 along the axial direction thereinside at an approximate central position corresponding to the engaging aperture 21; a lock pin 34 provided so as to be freely slidable inside the slide bore 35 of the one vane 28; a coil spring 39 constituting a spring member resiliently fitted to a rear end side of the lock pin 34; and a pressure receiving chamber 40 formed between the lock pin 34 and the slide bore 35.

The lock pin 34 comprises: a main member 34*a* of an intermediate diameter shape on a central side; an engaging member 34*b* formed in an approximate cone shape tapering towards the tip, on a tip end side of the main member 34*a*; and a stop portion 34*c* of a stepped larger diameter shape formed on the rear end side of the main member 34*a*. By means of the spring force of the coil spring 39 resiliently fitted between a bottom face of an internal recess groove 34*d* of the stop portion 34*c* and an inner end face of the front cover 7, the lock pin 34 is urged in the direction of the engaging aperture 21. Moreover, by means of the oil pressure inside the pressure receiving chamber 40 formed between the outer peripheral face between the main member 34*a* and the stop portion 34*c*, and the inner peripheral face of the slide bore 35, the lock pin 34 is slidingly moved in the direction of extraction from the engaging aperture 21. Furthermore, the pressure receiving chamber 40 is communicated with the delay angle side hydraulic chambers 33 by means of a through hole 36 formed in the side portion of the vane 28. Moreover, with the engaging member 34*b* of the lock pin 34, in the rotation position on the maximum delay angle side of the rotation member 3, the engaging member 34*b* is engagingly inserted into the engaging aperture 21.

The hydraulic circuit 4 has a dual system oil pressure passage, namely a first oil pressure passage 41 for supplying and discharging oil pressure with respect to the advance angle side hydraulic chambers 32, and a second oil pressure passage 42 for supplying and discharging oil pressure with respect to the delay angle side hydraulic chambers 33. These two oil pressure passages 41 and 42 are connected via an electromagnetic switching valve 45 for respectively switching the passages of a supply passage 43 and drain passages 44*a*, 44*b*. An oil pump 47 for pumping oil inside an oil pan 46 is provided in the supply passage 43, and downstream ends of the drain passages 44*a*, 44*b* are led to the oil pan 46.

The first oil pressure passage 41 comprises: a first passage portion 41*a* formed in an axially central portion of the cam shaft 2 leading from inside the cylinder head 22; a first oil passage 41*b* communicating with the first passage portion 41*a*, which passes axially through an inner portion of the fixing bolt 26 and branches inside the head portion 26*a*; an oil chamber 41*c* communicating with the first oil passage 41*b* and formed between a small diameter outer peripheral face of the head portion 26*a* and an inner peripheral face of the bolt through hole 27*a* inside the base portion 27 of the rotation member 3; and four branch passages 41*d* formed approximately radially inside the base portion 27 of the rotation member 3, for communicating the oil chamber 41*c* with the respective advance angle side hydraulic chambers 32.

On the other hand, the second oil pressure passage 42 comprises: a second passage portion 42*a* formed in the, cylinder head 22 and the inner one side of the cam shaft 2; a second oil passage 42*b* bent to be formed in an approximate L-shape in an inner portion of the sleeve 25, for communicating with the second passage portion 42*a*; four oil passage grooves 42*c* formed in the outer peripheral side aperture edge of the engaging bore 11 of the rotation portion 5, for communicating with the second oil passage 42*b*; and four oil holes 42*d* formed in the rear cover 8 at approximate 90° positions in the circumferential direction, for communicating between the respective oil passage grooves 42*c* and the delay angle side hydraulic chambers 33.

With the electromagnetic switching valve 45 (control valve), an internal spool valve element is arranged so as to control relative switching between the respective oil pressure passages 41 and 42, and the supply passage 43 and drain passages 44*a* and 44*b*. The switching operation is effected by a control signal from a controller 48.

Figure 4:
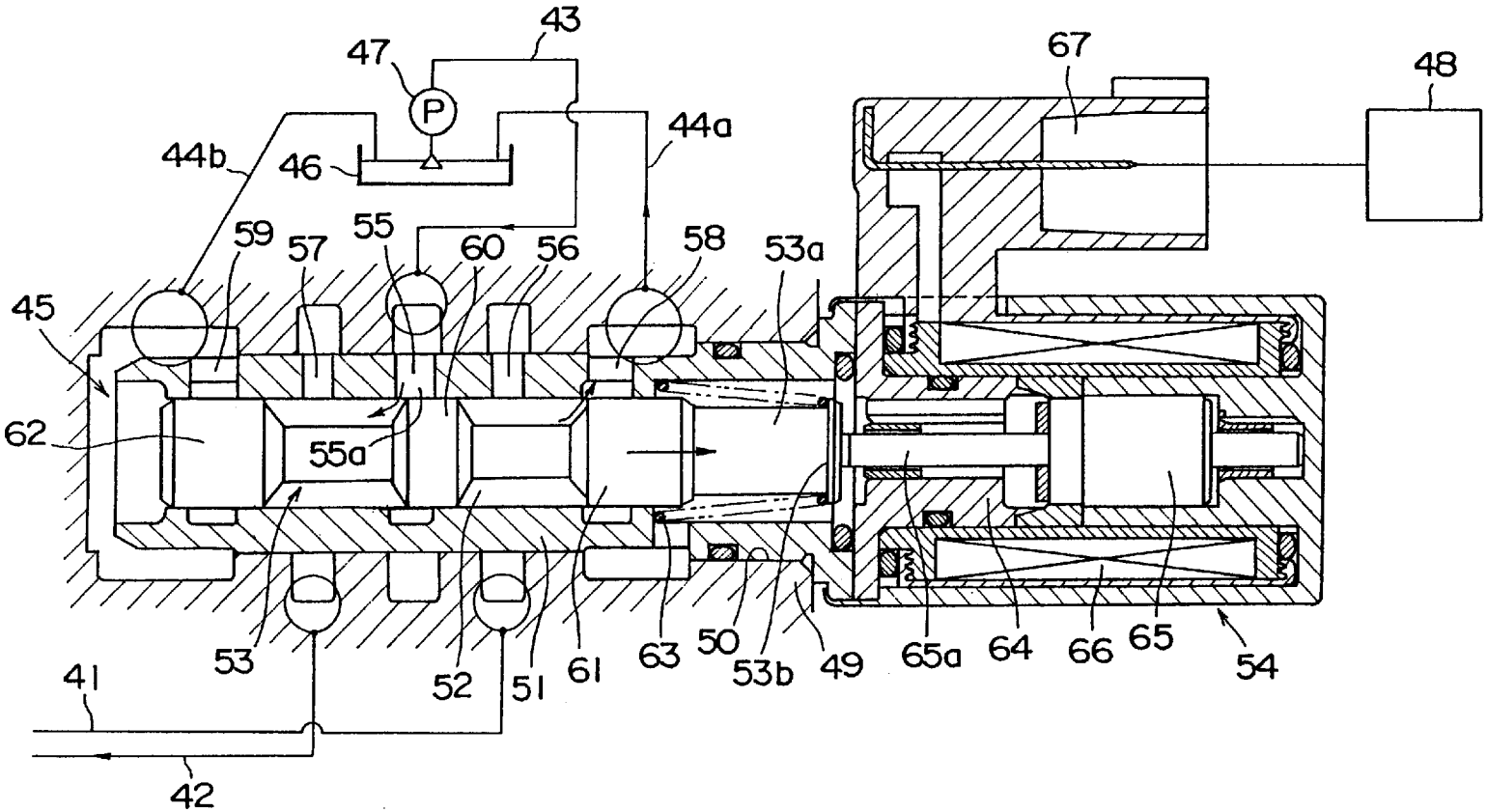
FIG. 4 is a longitudinal section view showing an electromagnetic switching valve at the time of delay angle, in the variable valve timing mechanism.
Figure 5:
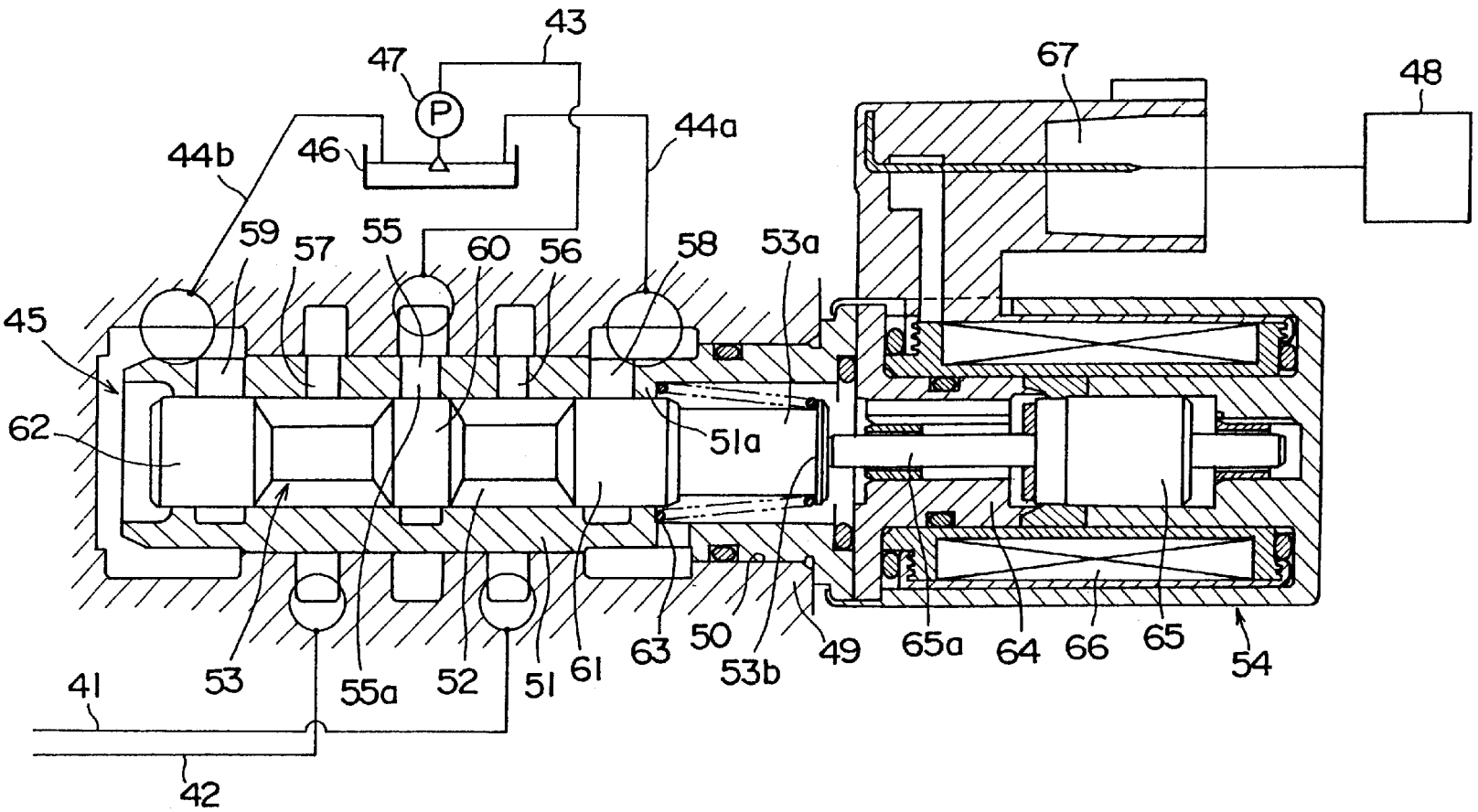
FIG. 5 is a longitudinal section view showing the electromagnetic switching valve in an oil pressure maintained condition, in the variable valve timing mechanism.
Figure 6:
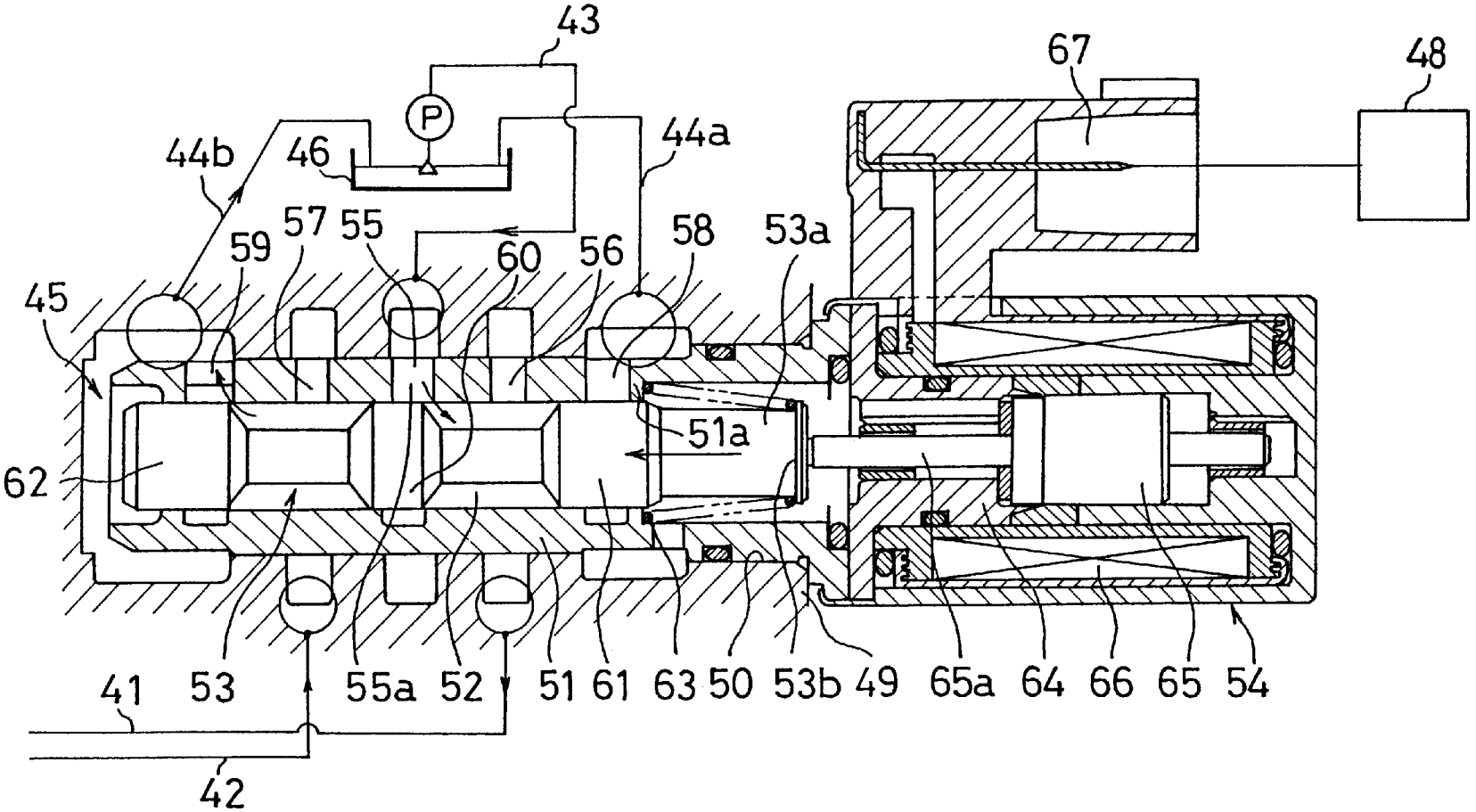
FIG. 6 is a longitudinal section view showing the electromagnetic switching valve at the time of advance angle, in the variable valve timing mechanism.

More specifically, as shown in FIG. 4 through FIG. 6, the electromagnetic switching valve 45 comprises a cylindrical valve body 51 insertingly secured inside a retaining bore 50 of a cylinder block 49, a spool valve element 53 provided so as to slide freely inside a valve bore 52 in the valve body 51 for switching the flow passages, and a proportional solenoid type electromagnetic actuator 54 for operating the spool valve element 53.

With the valve body 51, a supply port 55 is formed in an approximately central position of the peripheral wall, for communicating a downstream side end of the supply passage 43 with the valve bore 52, and a first port 56 and a second port 57 are respectively formed in opposite sides of the supply port 55, for communicating the other end portion of the oil pressure passages 41 and 42 with the valve bore 52. Moreover, third and fourth ports 58 and 59 are formed in the opposite end portions of the peripheral wall of the valve body 51, for communicating the two drain passages 44*a* and 44*b* with the valve bore 52.

The spool valve element 53 has an approximate columnar shape first valve portion 60 on a central portion of a small diameter axial portion, for opening and closing the supply port 55, and has approximate columnar shape second and third valve portions 61 and 62 on opposite end portions, for opening and closing the third and fourth ports 58 and 59. Furthermore, the spool valve element 53 is urged to the right in the figure, such that the supply port 55 and the second oil pressure passage 42 are communicated by the first valve portion 60, by means of a conical shape valve spring 63 resiliently provided between an umbrella portion 53*b* on one edge of a front end spindle 53*a*, and a spring seat 51*a* on a front end inner peripheral wall of the valve bore 52, that is to say, in a direction.

The electromagnetic actuator 54 is provided with a core 64, a moving plunger 65, a coil 66, and a connector 67. A drive rod 65*a* is secured to a tip end of the moving plunger 65 for pressing against the umbrella portion 53*b* of the spool valve element 53.

The controller 48 detects the current operating conditions (load, rotation) by means of signals from a rotation sensor 101 for detecting engine rotation speed and an air flow meter 102 for detecting intake air quantity, and detects the relative rotation position of the cam sprocket 1 and the cam shaft 2, that is to say the rotation phase of the cam shaft 2 with respect to the crank shaft, by means of signals from a crank angle sensor 103 and a cam sensor 104.

The controller 48 controls the energizing quantity for the electromagnetic actuator 54 based on a duty control signal superimposed with a dither signal.

For example, when a control signal of duty ratio 0% (off signal) is output from the controller 48 to the electromagnetic actuator 54, the spool valve element 53 moves to the position shown in FIG. 4, that is to say towards the maximum right direction, under the spring force of the valve spring 63. As a result, the first valve portion 60 opens an opening end 55*a* of the supply port 55 to communicate with the second port 57, and at the same time the second valve portion 61 opens an opening end of the third port 58, and the fourth valve portion 62 closes the fourth port 59.

Therefore, the operating oil pumped from the oil pump 47 is supplied to the delay angle side hydraulic chambers 33 via the supply port 55, the valve bore 52, the second port 57, and the second oil pressure passage 42, and the operating oil inside the advance angle side hydraulic chambers 32 is discharged to inside the oil pan 46 from the drain passage 44*a* via the first oil pressure passage 41, the first port 56, the valve bore 52, and the third port 58.

Consequently, the pressure inside the delay angle side hydraulic chambers 33 becomes a high pressure while the pressure inside the advance angle side hydraulic chambers 32 becomes a low pressure, and the rotation member 3 is rotated to the full in one direction by means of the vanes 28*a* to 28*d*. Due to this, the cam sprocket 1 and the cam shaft 2 are relatively rotated to one side so that the phase is changed. The result of this is that the opening timing for the intake valves is delayed, and the overlap with the exhaust valves is thus reduced.

On the other hand, when a control signal of a duty ratio 100% (on signal) is output from the controller 48 to the electromagnetic actuator 54, the spool valve element 53 slides fully to the left as shown in FIG. 6 against the spring force of the valve spring 63, so that the second valve portion 61 closes the third port 58 and at the same time the third valve portion 62 opens the fourth port 59, and the first valve portion 60 allows communication between the supply port 55 and the first port 56.

Therefore, the operating oil is supplied to inside the advance angle side hydraulic chambers 32 via the supply port 55, the first port 56, and the first oil pressure passage 41, and the operating oil inside the delay angle side hydraulic chambers 33 is discharged to the oil pan 46 via the second oil pressure passage 42, the second port 57, the fourth port 59, and the drain passage 44*b*, so that the delay angle side hydraulic chambers 33 become a low pressure.

Therefore, the rotation member 3 is rotated to the full in the other direction by means of the vanes 28*a* to 28*d*. Due to this, the cam sprocket 1 and the cam shaft 2 are relatively rotated to the other side so that the phase is changed. The result of this is that the opening timing for the intake valve is advanced (advance angle) and the overlap with the exhaust valve is thus increased.

The controller 48 makes a duty ratio for a position where the first valve portion 60 closes the supply port 55, the second valve portion 61 closes the third port 58, and the third valve portion 62 closes the fourth port 59, a base duty ratio BASEDTY (for example 50%). Moreover, the controller 48 sets by proportional+integral+differential operation (PID), a feedback correction amount PIDDTY for making a relative rotation position (rotation phase) of the cam sprocket 1 and the cam shaft 2 detected based on signals from the crank angle sensor 103 and the cam sensor 104, coincide with a target value (target advance angle value) for the relative rotation position (rotation phase) set corresponding to the operating conditions. The controller 48 then makes the result of adding the base duty ratio BASEDTY to the feedback correction amount PIDDTY a final duty ratio VTCDTY, and outputs a control signal for the duty ratio VTCDTY to the electromagnetic actuator 54.

That is to say, in the case where it is necessary to change the relative rotation position (rotation phase) in the delay angle direction, the duty ratio is reduced by means of the feedback correction amount PIDDTY, so that the operating oil pumped from the oil pump 47 is supplied to the delay angle side hydraulic chambers 33, and at the same time the operating oil inside the advance angle side hydraulic chambers 32 is discharged to inside the oil pan 46. Conversely, in the case where it is necessary to change the relative rotation position (rotation phase) in the advance angle direction, the duty ratio is increased by means of the feedback correction amount PIDDTY, so that the operating oil is supplied to inside the advance angle side hydraulic chambers 32, and at the same time the operating oil in side the delay angle side hydraulic chambers 33 is discharged to the oil pan 46.

Furthermore, in the case where the relative rotation position (rotation phase) is maintained in the current condition, the controller 48 controls so that the absolute value of the feedback correction amount PIDDTY is reduced to thereby return to a duty ratio close to the base duty ratio, and controls so that the internal pressure of the respective hydraulic chambers 32 and 33 is maintained by closing the supply port 55, the third port 58, and the fourth port 59 (supply and discharge of oil pressure is stopped).

The function of the controller 48 for detecting the relative rotation position (rotation phase) between the cam sprocket 1 and the cam shaft 2 based on signals from the crank angle sensor 103 and the cam sensor 104 corresponds to a rotation phase measuring device and a rotation phase measuring means, while the computation function of the feedback correction amount PIDDTY by the controller 48 corresponds to a control signal computing device, a control signal computing means, a feedback control device and a feedback control means.

Figure 7:
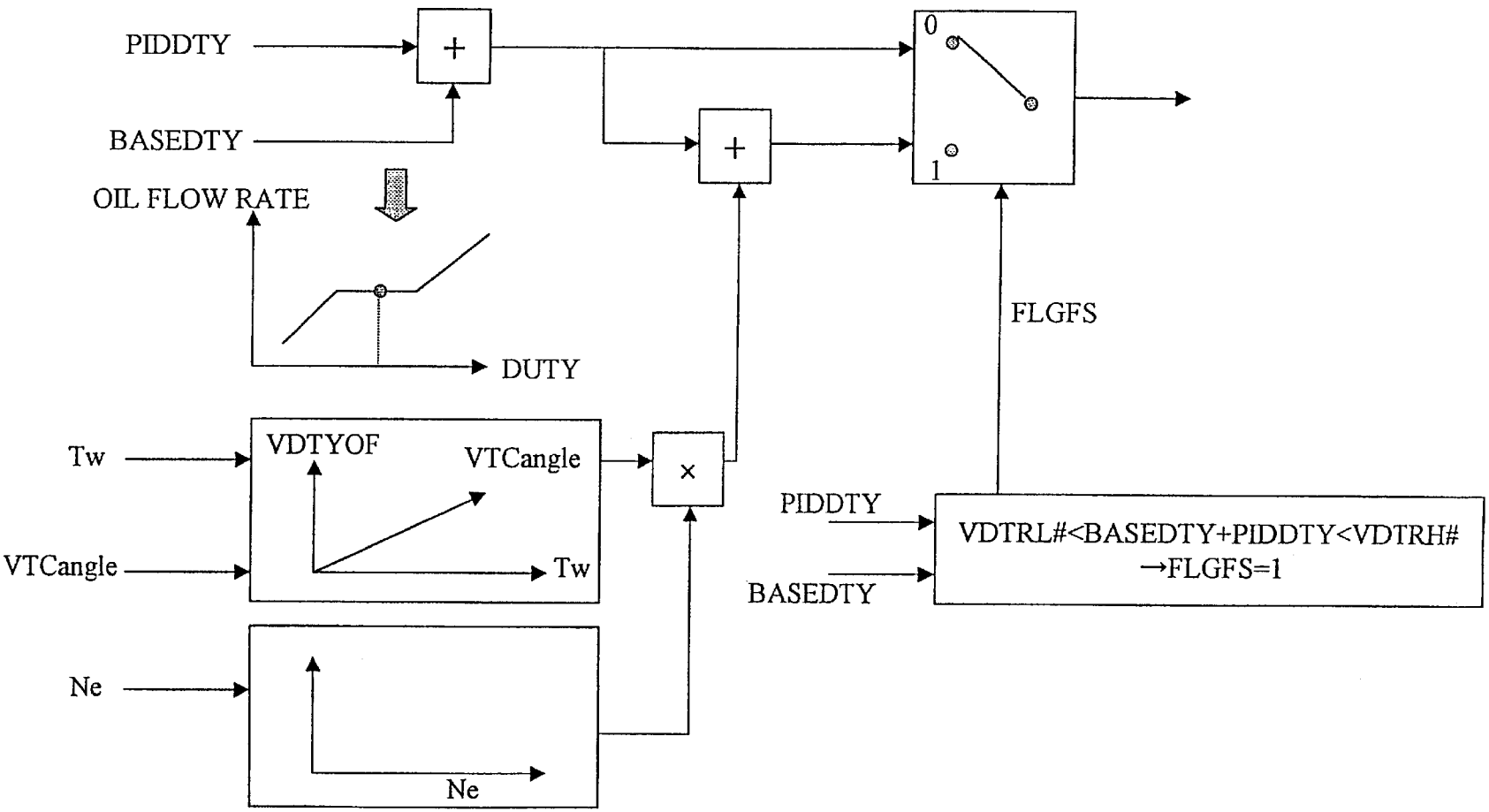
FIG. 7 is a control block diagram illustrating a first embodiment of a control for the variable valve timing mechanism.

FIG. 7 is a block diagram showing a first embodiment of a duty control for an electromagnetic actuator 54 by means of the controller 48.

As shown in FIG. 7, an addition value for the base duty ratio BASEDTY and the feedback correction amount PIDDTY is obtained, and a duty ratio where a predetermined offset amount is added to this addition value is then computed. The arrangement is such that one of, the duty ratio with the offset amount not added, and the duty ratio with the offset amount added is selectively output.

As shown in FIG. 7, the base duty ratio BASEDTY is set to an approximate central value of a duty ratio range in which the supply port 55, the third port 58, and the fourth port 59 are closed together so that supply and discharge of oil is not performed for either of the hydraulic chambers 32 or 33.

When the value for where the feedback correction amount PIDDTY is added to the base duty ratio BASEDTY is within a predetermined range (VDTRL#<BASEDTY+PIDDTY<VDTRH#), specifically this includes the duty ratio range where oil supply and discharge is not performed for either of the hydraulic chambers 32 or 33. When this is within a range slightly wider than the duty ratio range the offset addition is selected. By adding the offset, a slight deviation of the relative rotation position (rotation phase) occurs, and a feedback control is made to perform supply and discharge of oil for the hydraulic chambers in order to cancel the deviation. When by means of this feedback control, conditions return to close to the target (where the feedback control approximately converges), then again the offset is added. Consequently periodic fluctuations occur within a narrow range close to the target.

Due to this, even under conditions where the target relative rotation position (rotation phase) does not change, the condition where the supply port 55, the third port 58, and the fourth port 59 are all closed so that supply and discharge of oil is not performed for either of the hydraulic chambers 32 or 33, is not maintained, and supply and discharge of oil is continuously performed.

When the abovementioned value for where the feedback correction amount PIDDTY is added to the base duty ratio BASEDTY is within the predetermined range (VDTRL#<BASEDTY+PIDDTY<VDTRH#), the function for offsetting the duty ratio corresponds to a forced supply and discharge device, a forced supply and discharged means, an offset device, and an offset means.

When the cam torque acts in the condition with the supply port 55, the third port 58 and the fourth port 59 all closed so that oil supply and discharge is not performed for either of the hydraulic chambers 32 and 33, the pressure inside the hydraulic chambers to which a positive torque is applied increases so that oil leakage occurs. Conversely, when a negative torque is applied, there is the possibility of air being drawn in from the position of the leakage. Due to the drawing in of air, the cam torque increases so that oscillations becomes large. As a result the relative rotation position (rotation phase) hunts excessively.

On the other hand, if as described above the construction is such that supply and discharge of oil is continuously performed, the beforementioned intake of air can be prevented and hence the occurrence of hunting due to the intake of air can be prevented.

Incidentally, since it is desirable to have the offset amount at a value where deviation of the relative rotation position (rotation phase) occurs as little as possible, this offset amount is made so as to be variably set in accordance with the operating conditions.

With the present embodiment, the basic value VDTYOF of the offset amount is set based on the target value (target advance angle value) VTCangle of the relative rotation position (rotation phase), and the engine coolant temperature Tw detected by a water temperature sensor 105. Moreover, the construction is such that the basic value VDTYOF is corrected by a correction coefficient corresponding to the engine rotation speed.

The setting function for the offset amount corresponds to an offset amount setting device.

With the target value VTC angle, being a parameter representing the volume of the hydraulic chambers 32 and 33, since the sensitivity of the pressure change corresponding to the oil pressure control is degraded the larger the volume, then the offset amount is variably set in accordance with the target value VTC angle.

Furthermore, the coolant temperature Tw is used as a temperature correlated with the temperature of the operating oil. Moreover, the temperature of the operating oil is a parameter correlated with the viscosity of the operating oil, and the offset amount is variably set corresponding to the difference in sensitivity due to the difference in the viscosity of the oil. Consequently, the function for judging the coolant temperature Tw as a temperature correlated with the above-mentioned temperature of the operating oil, corresponds to an oil temperature estimation device.

The construction may be such that the temperature of the operating oil is detected directly, and a basic value VDTYOF is set using the detection result.

Moreover, the engine rotation speed is correlated with the magnitude of the cam torque, and is a parameter correlated with the supply quantity of operating oil by means of the oil pump, and is corrected to an appropriate; offset amount corresponding to these conditions.

Here a construction is also possible where the supply pressure of the operating oil from the oil pump is detected with a pressure sensor, and the offset amount is variably set based on this supply pressure. The supply pressure as with the supply quantity of the oil, is a parameter correlated with the sensitivity of the pressure change due to the oil pressure control.

The offset amount may be a positive value (advance angle direction) or may be a negative value (delay angle direction).

Figure 8:
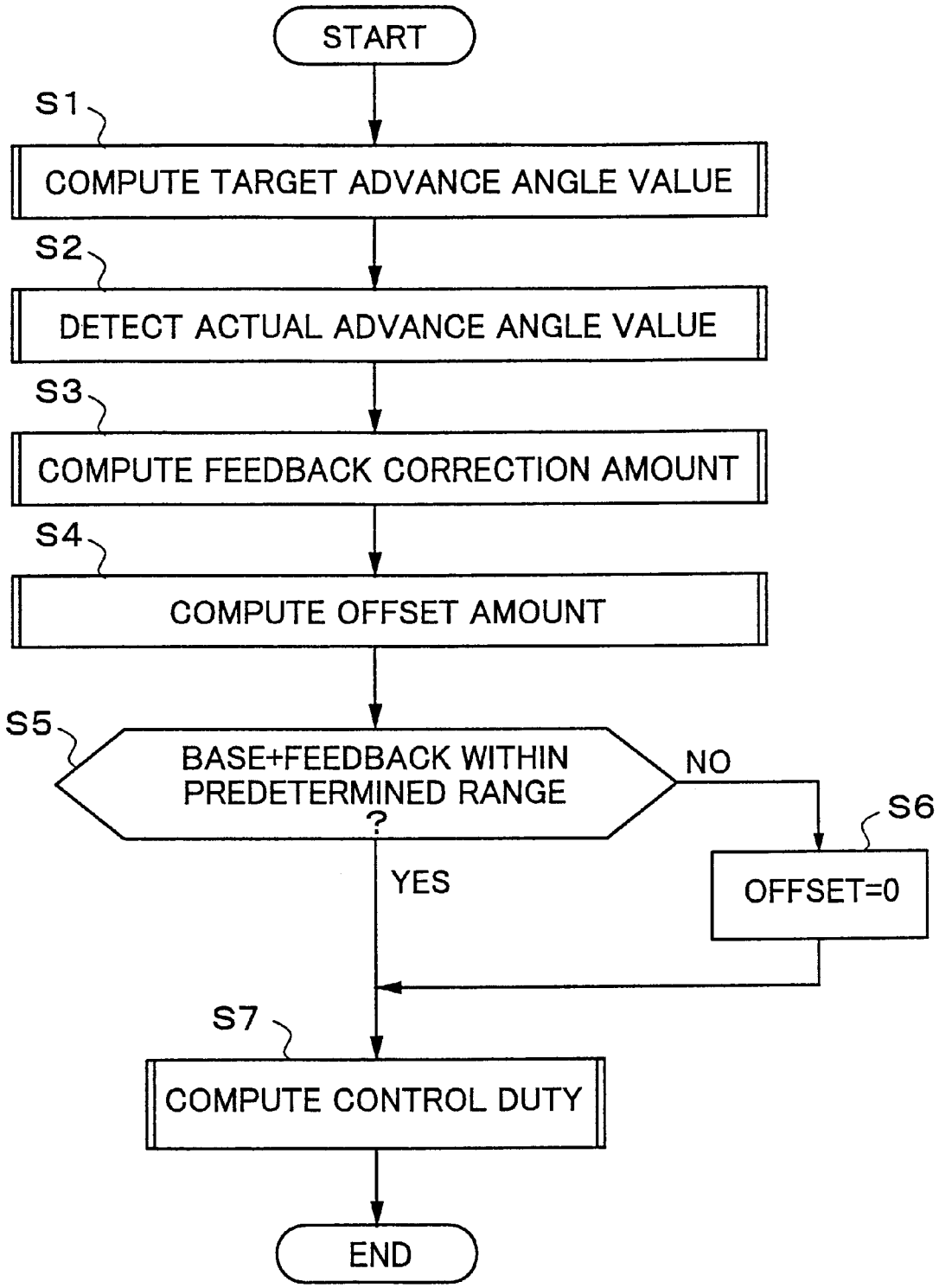
FIG. 8 is a flow chart illustrating the first embodiment.

The flow chart of FIG. 8 shows the control function in the first embodiment shown in FIG. 7. In step S1 a target advance angle value is computed, and in step S2 an actual advance angle value is detected, while in step S3 a feedback correction amount PIDDTY is computed by superimposing with a dither signal.

The function of step S2 corresponds to a rotation phase measuring device and a rotation phase measuring means, and the function of step S3 corresponds to a feedback control device and a feedback control means.

Then in step S4, serving as an offset amount setting device, the offset amount is variably set corresponding to, target advance angle value, water temperature (oil temperature), engine rotation speed and the like.

In step S5, it is judged if an addition value of the base duty ratio BASEDTY and the feedback correction amount PIDDTY is within a predetermined range. When not within the predetermined range, that is to say at the time of the condition where the supply and discharge of oil for the hydraulic chamber is performed even if the offset amount is not added, then in step S6, the offset amount is reset to zero. If this is within the predetermined range, the computational result for the offset amount in step S4 is maintained as such, and control proceeds to step S7.

In step S7, an addition value for the base duty ratio BASEDTY, the feedback correction amount PIDDTY, and the offset amount VDTYOF is obtained. Furthermore, a correction corresponding to the power source voltage is added to the addition value, and a final control duty thus determined.

The function of step S7 corresponds to an offset device and offset means.

Figure 9:
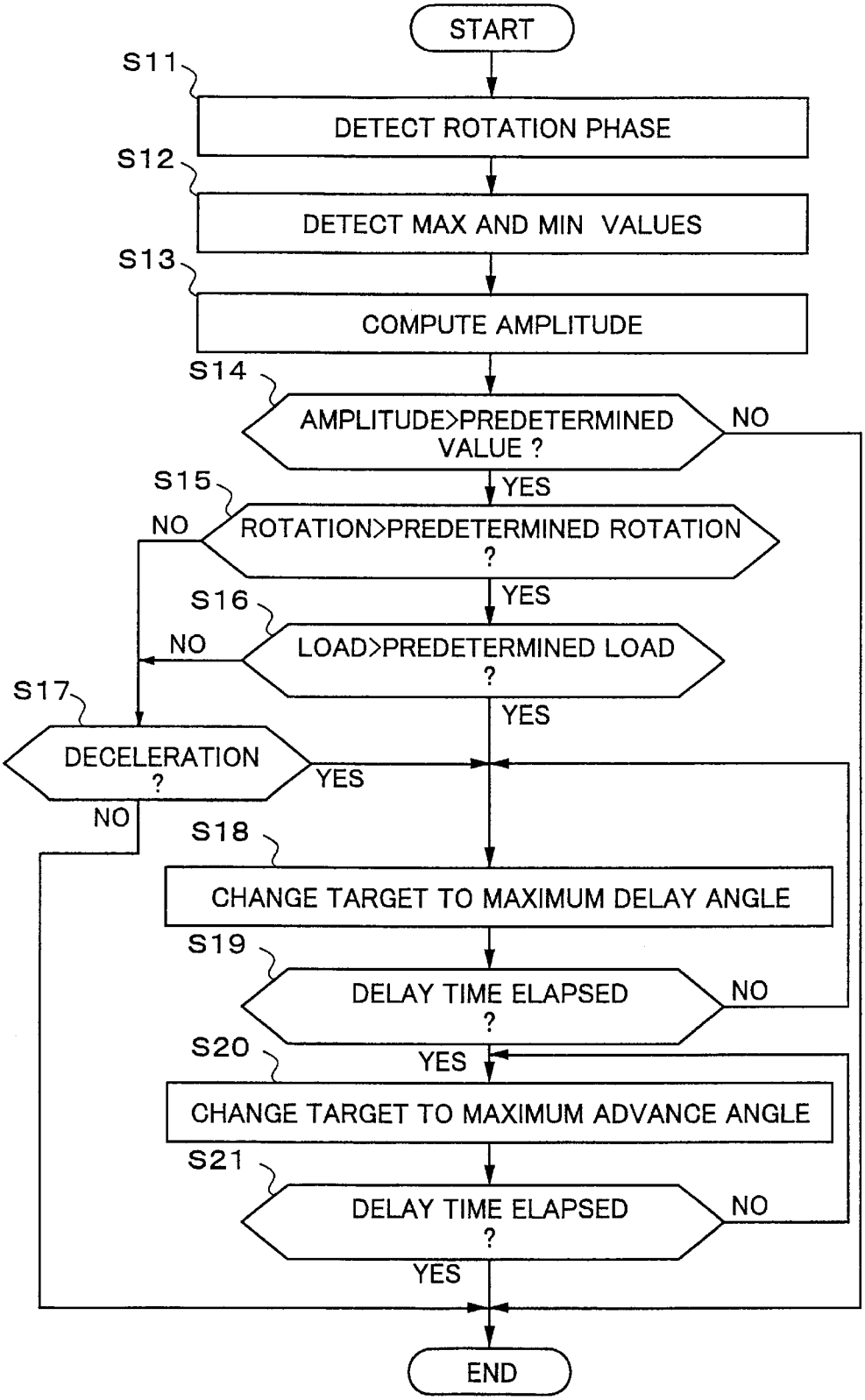
FIG. 9 is a flow chart illustrating a second embodiment of a control for the variable valve timing mechanism.

Next, a second embodiment of a duty control of the electromagnetic actuator 54 by means of the controller 48, is explained according to the flow chart of FIG. 9.

In step S11, an actual rotation phase (advance angle value) is detected based on signals from the crank angle sensor 103 and the cam sensor 104. The function of step S11 corresponds to a rotation phase measuring device and a rotation phase measuring means.

In step S12, the maximum and minimum values for the rotation phase detected in step S11 are obtained.

In step S13, the amplitude of the rotation phase is computed as the deviation between the maximum value and minimum value. The function of step S13 corresponds to an amplitude computing device and an amplitude computing means.

Instead of obtaining the deviation between the maximum value and minimum value, the construction may be such that the standard deviation or the like of the rotation phase is computed.

In step S14, serving as an amplitude judgment device, it is judged if the detection result of the amplitude exceeds a predetermined value.

When in step S14 it is judged that the detection result of the amplitude exceeds the predetermined value, it is assumed that air is drawn into the interior of the hydraulic chambers 32 and 33 due to the operation of the cam torque, and the rotation phase fluctuates with an excessive amplitude due to this entrained air. Control thus proceeds to step S15 and thereafter.

Step S15 through step S17 are for judging allowable conditions of control for removing the air which has been entrained to inside the hydraulic chambers 32 and 33. In step S15, it is judged if the engine rotation speed is above a predetermined speed. If above the predetermined speed, control proceeds to step S16.

In step S16, it is judged if the engine load is above a predetermined load based on the engine intake air quantity or the like.

Then, when the engine rotation speed is above the predetermined speed, and the engine load is above the predetermined load, it is judged that even if a later described forcible change of the target rotation phase is made, there will not be a large influence on operability, and control proceeds to step S18 and thereafter.

On the other hand, when judged that the conditions of the engine rotation speed or engine load have not been established, control proceeds to step S17 where it is judged if the engine is in a deceleration operation condition (preferably, a deceleration fuel cut condition).

When judged that the engine is in a deceleration operation condition, even though there is the case where the conditions of the engine rotation speed and engine load have not been established, it is judged that even if a later described forcible change of the target rotation phase is made there will not be a large influence on operability, and control proceeds to step S18 and thereafter. That is to say, when the detection result for the amplitude exceeds the predetermined value, and the engine rotation speed and engine load are within the predetermined range an also the engine is in a deceleration operation condition, control proceeds to step S18 and thereafter.

In step S18 the target rotation phase is forcibly changed to a maximum delay angle.

The functions of step S18 and a later mentioned step S20 correspond to a forced supply and discharge device, a forced supply and discharge means, a target value change device, and a target value change means.

In the above manner, by forcibly making the target rotation phase a maximum delay angle, oil is supplied to the delay angle side hydraulic chambers 33 in order to increase the oil pressure in the delay angle side hydraulic chambers 33, while oil is drained from the advance angle side hydraulic chambers 32, so that air which has been entrained into the oil inside the advance angle side hydraulic chambers 32 is discharged together with the oil.

In step S19, in judging the elapse of a predetermined delay time, it is judged if after forcibly changing the target rotation phase to the maximum delay angle, a necessary and sufficient time for discharge of oil from the advance angle side hydraulic chambers 32 has elapsed. Instead of judging the elapse of the predetermined delay time, it can be judged if the actual rotation phase has come close to the maximum delay angle.

In step 19, when the lapse of the predetermined delay time is judged, control proceeds to step S20, and this time the target rotation phase is forcibly changed to the maximum advance angle.

In the above manner, by forcibly making the target rotation phase a maximum advance angle, oil is supplied to the advance angle side hydraulic chambers 32 in order to increase the oil pressure in the advance angle side hydraulic chambers 32, while oil is drained from the delay angle side hydraulic chambers 33, so that air which has been entrained into the oil inside the delay angle side hydraulic chambers 33 is discharged together with oil.

In step S21, in judging the elapse of a predetermined delay time, it is judged if after forcibly changing the target rotation phase to the maximum advance angle, a necessary and sufficient time for discharge of oil from the delay angle side hydraulic chambers 33 has elapsed. Here also, instead of judging the elapse of the predetermined delay time, it can be judged if the actual rotation phase has come close to the maximum advance angle.

In step S21, when the lapse of the predetermined delay time is judged, the target rotation phase reverts to the normal value, and the routine terminates.

In the above manner, when the amplitude of the rotation phase becomes large exceeding an allowable level, by forcibly oscillating the target rotation phase between the maximum delay angle and the maximum advance angle so that the oil pressure of the hydraulic chambers 32 and 33 is forcibly circulated, the air which has been entrained in the hydraulic chambers 32 and 33 can be discharged, and the fluctuations in the rotation phase which are caused by the entrained air can be converged.

Moreover, since discharging of air by changing in the target rotation phase is limited to when the engine operating conditions are such that a change of the rotation phase does not have a large influence on operability, then the influence on operability can be suppressed to a minimum.

Figure 10:
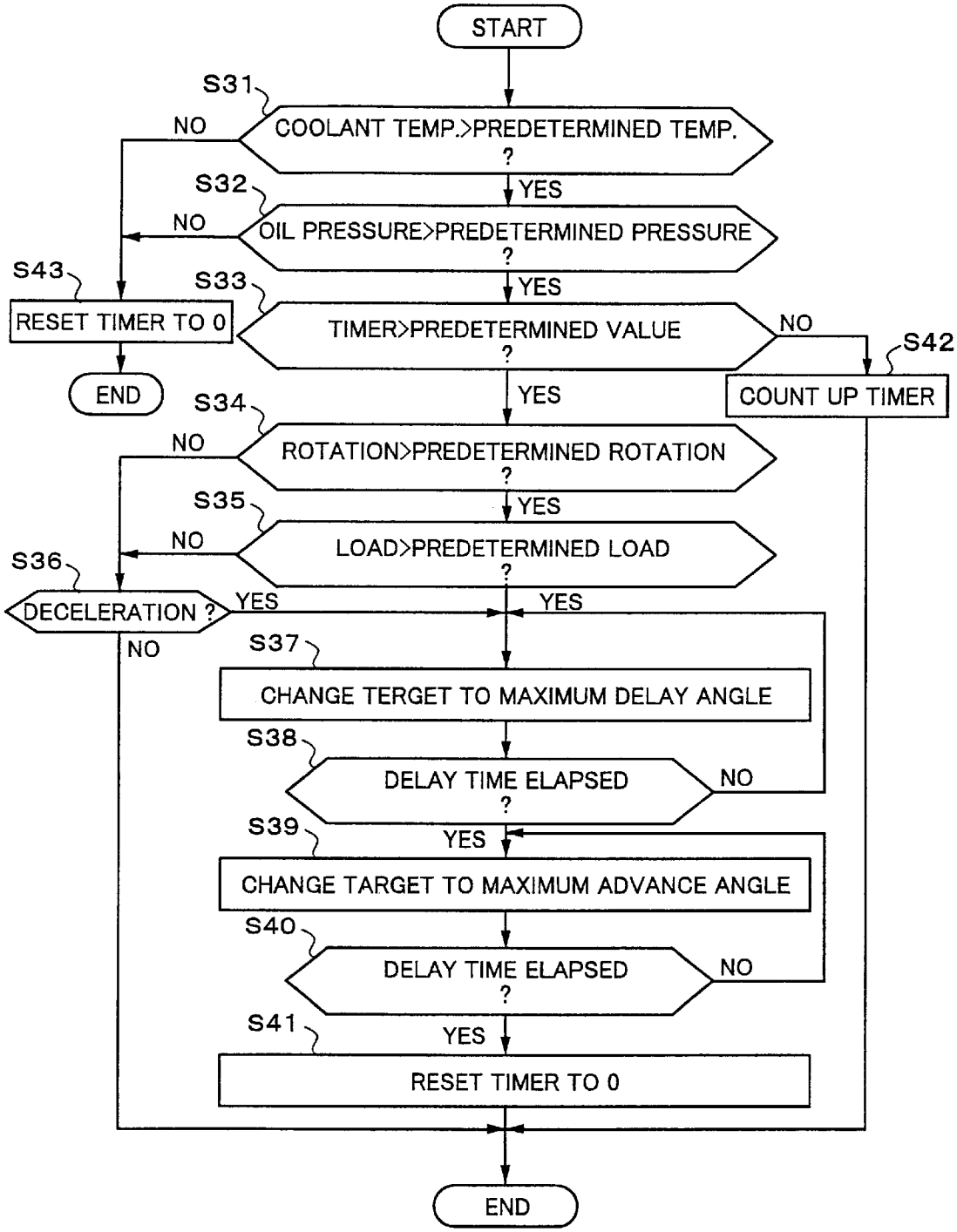
FIG. 10 is a flow chart showing a third embodiment of a control for the variable valve timing mechanism.

The flow chart of FIG. 10 shows a third embodiment of a duty control of the electromagnetic actuator 54 by means of the controller 48. As with the second embodiment, the oil inside the respective hydraulic chambers 32 and 33 is circulated by forcibly changing the rotation phase to thereby remove any air.

In step S31 it is judged if the engine coolant temperature detected by the water temperature sensor 105 is above a predetermined temperature. The coolant temperature is judged as a parameter correlated with the temperature of the operating oil, and when the coolant temperature is above the predetermined temperature, it is assumed that the temperature of the operating oil is at a predetermined high temperature condition. Consequently, the function of step S32 corresponds to an oil temperature estimation device.

The construction may be such that the temperature of the operating oil is directly detected.

When the coolant temperature is above the predetermined temperature, control proceeds to step S32 where it is judged if the supply pressure of the operating oil by the oil pump 47 is below a predetermined pressure, based on the detection result of an oil pressure sensor 106 provided on the downstream side of the oil pump 47.

In the case where the construction is such that the oil pump 47 is driven by the crank shaft, then since the engine rotation speed is a parameter correlated with the supply pressure of the operating oil, the construction may be such that the supply pressure of the operating oil is judged by judging if the engine rotation speed is above predetermined value set differently from that in step S15 and a later described step S34.

In step S32, when judged that the oil pressure is below a predetermined pressure, it is judged that the possibility of large fluctuations in the rotation phase is. high, and control proceeds to step S33 and thereafter.

The functions of step S31 and step S32 correspond to an oil pressure control condition detection device, an oil pressure control condition detection, means, and an amplitude judgment device.

When the engine coolant temperature is above the predetermined temperature, and it is thus assumed that the temperature of the operating oil is above the predetermined temperature, the viscosity of the operating oil is low so that oil leakage when the cam torque is applied is likely to occur. Therefore, drawing in of air to the hydraulic chambers is likely to occur. Moreover, in the condition where the oil pressure is low, compared to when the oil pressure is high, the rotation phase fluctuates at a greater amplitude even if the same cam torque is applied, so that the intake amount of air also increases.

Therefore, in step S33 and thereafter, as with the second embodiment illustrated in FIG. 9, at the time of predetermined engine operating conditions, a process is periodically performed for forcibly oscillating the target rotation phase between the maximum delay angle and the maximum advance angle. so that the oil pressure of the hydraulic chambers 32 and 33 is forcibly circulated.

In step S33, it is judged if the value of a timer for measuring the execution interval of the forcible circulation control is above a predetermined value. In the case where this has not reached above the predetermined value, control proceeds to step S42, and the timer is counted up.

With the timer, in the case where the condition of the oil temperature and oil pressure has not been established so that control has not proceeded to step S33, then in step S43, the timer is reset to zero.

In step S33, when judged that the value of the timer is above the predetermined value, control proceeds to step S34.

The processing of step S34 and thereafter is the same as for step S15 through step S21 of the flow chart of FIG. 9. In step S34 through step S36 it is judged, if there is a load and rotation region, and also if there is a deceleration operation condition, that is, if there are operating conditions which can permit forcible changing of the rotation phase between the maximum delay angle and the maximum advance angle.

When there is the predetermined load and rotation regions and also the deceleration operation condition, control proceeds to step S37 through step S40. After the target for the rotation phase has been forcibly set to the maximum delay angle, and the maximum delay angle condition has continued for a predetermined delay time, then next, processing is performed so that the target for the rotation phase is forcibly set to the maximum advance angle and this continues for a predetermined delay time. By doing this then the oil pressure of the hydraulic chambers 32 and 33 is forcibly circulated, the air which has been entrained in the hydraulic chambers 32 and 33 is discharged, and the fluctuations in the rotation phase which are caused by the entrained air are converged.

The functions of step S37 through step S40 correspond to a forced supply and discharge device, a forced supply and discharge means, a target value change device, and a target value change means.

In step S41, the timer is reset to zero, and the forcible change of the rotation phase is not carried out again until the value of the timer is counted up to a predetermined value.

What we claimed are:

1. An apparatus for controlling valve timing of an engine comprising:

a housing connected to a cam sprocket, with recess portions therein;

a rotation member connected to an end portion of a cam shaft and incorporating vanes integrally disposed in said recess portions, and partitioning each of said recess portions by each of said vanes to thereby form advance angle side hydraulic chambers and delay angle side hydraulic chambers at both sides of said respective vanes;

a control valve for relatively controlling the supply and discharge of oil pressure to said advance angle side hydraulic chambers and delay angle side hydraulic chambers;

a rotation phase measuring device for measuring a rotation phase of said cam shaft with respect to a crank shaft;

a feedback control device for feedback controlling a control signal for said control valve so that a rotation phase measured by said rotation phase measuring device coincides with a target value; and an offset device which computes an offset to be added to said control signal when a feedback control by said feedback control device is converged, and when said control signal becomes within a predetermined range, forcibly drives a valve timing apparatus based on said control signal added with said offset.

2. The apparatus according to claim 1, wherein an offset amount setting device is provided for variably setting an offset amount corresponding to a target value of said rotation phase.

3. The apparatus according to claim 1, wherein an offset amount setting device is provided for variably setting an offset amount corresponding to a temperature of operating oil.

4. The apparatus according to claim 3, wherein an oil temperature estimating device is provided for estimating the temperature of said operating oil corresponding to an engine cooling water temperature.

5. The apparatus according to claim 1, wherein an offset amount setting device is provided for variably setting an offset amount corresponding to an engine rotation speed.

6. The apparatus according to claim 1, wherein an offset amount setting device is provided for variably setting an offset amount corresponding to supply pressure of operating oil.

7. An apparatus for controlling valve timing of an engine comprising:

a housing connected to a cam sprocket, with recess portions therein;

a rotation member connected to an end portion of a cam shaft and incorporating vanes integrally disposed in said recess portions, and partitioning each of said recess portions by each of said vanes to thereby form advance angle side hydraulic chambers and delay angle side hydraulic chambers at both sides of said respective vanes;

a control valve for relatively controlling the supply and discharge of oil pressure to said advance angle side hydraulic chambers and delay angle side hydraulic chambers;

a rotation phase measuring device for measuring a rotation phase of said cam shaft with respect to a crank shaft;

a feedback control device for feedback controlling a control signal for said control valve so that a rotation phase measured by said rotation phase measuring device coincides with a target value;

an amplitude judging device for judging a condition where an amplitude in hunting of said rotation phase is above a predetermined value; and a target value change device for forcibly changing a target value of said rotation phase when said amplitude judging device judges that there is a condition where an amplitude of said rotation phase is above a predetermined value, wherein said amplitude judging device computes said amplitude based on a measurement result by said rotation phase measuring device, to judge whether or not the computed amplitude is above a predetermined value.

8. An apparatus for controlling valve timing of an engine comprising:

a housing connected to a cam sprocket, with recess portions therein;

a rotation member connected to an end portion of a cam shaft and incorporating vanes integrally disposed in said recess portions, and partitioning each of said recess portions by each of said vanes to thereby form advance angle side hydraulic chambers and delay angle side hydraulic chambers at both sides of said respective vanes;

a control valve for relatively controlling the supply and discharge of oil pressure to said advance angle side hydraulic chambers and delay angle side hydraulic chambers;

a rotation phase measuring device for measuring a rotation phase of said cam shaft with respect to a crank shaft;

a feedback control device for feedback controlling a control signal for said control valve so that a rotation phase measured by said rotation phase measuring device coincides with a target value;

an amplitude judging device for judging a condition where an amplitude in hunting of said rotation phase is above a predetermined value; and a target value change device for forcibly changing a target value of said rotation phase when said amplitude judging device judges that there is a condition where an amplitude of said rotation phase is above a predetermined value, wherein said amplitude judging device comprises;

an oil pressure control condition detection device for detecting an oil pressure control condition where it is predicted that the amplitude in hunting of said rotation phase will go above a predetermined value, and when said oil pressure control condition is detected by said oil pressure control condition detection device, judges that there is a condition where the amplitude in hunting of said rotation phase is above a predetermined value, and said target value changing device periodically performs a forcible change of said target value and, wherein said oil pressure control condition detection device, detects a condition where the temperature of the operating oil is above a predetermined temperature, as the oil pressure control condition where it is predicted that the amplitude in hunting of the rotation phase will go above a predetermined value.

9. The apparatus according to either of claims 7 or 8, wherein said target value change device forcibly changes the target value of said rotation phase to a maximum advance angle or a maximum delay angle.

10. An apparatus for controlling valve timing of an engine comprising:

a housing connected to a cam sprocket, with recess portions therein;

a rotation member connected to an end portion of a cam shaft and incorporating vanes integrally disposed in said recess portions, and partitioning each of said recess portions by each of said vanes to thereby form advance angle side hydraulic chambers and delay angle side hydraulic chambers at both sides of said respective vanes;

a control valve for relatively controlling the supply and discharge of oil pressure to said advance angle side hydraulic chambers and delay angle side hydraulic chambers;

a rotation phase measuring device for measuring a rotation phase of said cam shaft with respect to a crank shaft;

a feedback control device for feedback controlling a control signal for said control valve so that a rotation phase measured by said rotation phase measuring device coincides with a target value;

an amplitude judging device for judging a condition where an amplitude in hunting of said rotation phase is above a predetermined value; and a target value change device for forcibly changing a target value of said rotation phase when said amplitude judging device judges that there is a condition where an amplitude of said rotation phase is above a predetermined value, wherein said target value change device forcibly changes the target value of said rotation phase to either one of a maximum advance angle side and a maximum delay angle side, and then forcibly changes to the other side.

11. An apparatus for controlling valve timing of an engine comprising:

a housing connected to a cam sprocket, with recess portions therein;

a rotation member connected to an end portion of a cam shaft and incorporating vanes integrally disposed in said recess portions, and partitioning each of said recess portions by each of said vanes to thereby form advance angle side hydraulic chambers and delay angle side hydraulic chambers at both sides of said respective vanes;

a control valve for relatively controlling the supply and discharge of oil pressure to said advance angle side hydraulic chambers and delay angle side hydraulic chambers;

a rotation phase measuring device for measuring a rotation phase of said cam shaft with respect to a crank shaft;

a feedback control device for feedback controlling a control signal for said control valve so that a rotation phase measured by said rotation phase measuring device coincides with a target value;

an amplitude judging device for judging a condition where an amplitude in hunting of said rotation phase is above a predetermined value; and a target value change device for forcibly changing a target value of said rotation phase when said amplitude judging device judges that there is a condition where an amplitude of said rotation phase is above a predetermined value, wherein said target value change device forcibly changes the target value of said rotation phase, when said amplitude is above a predetermined value, and there is a high load and high rotation speed region of the engine.

12. An apparatus for controlling valve timing of an engine comprising:

a housing connected to a cam sprocket, with recess portions therein;

a rotation member connected to an end portion of a cam shaft and incorporating vanes integrally disposed in said recess portions, and partitioning each of said recess portions by each of said vanes to thereby form advance angle side hydraulic chambers and delay angle side hydraulic chambers at both sides of said respective vanes;

a control valve for relatively controlling the supply and discharge of oil pressure to said advance angle side hydraulic chambers and delay angle side hydraulic chambers;

a rotation phase measuring device for measuring a rotation phase of said cam shaft with respect to a crank shaft;

a feedback control device for feedback controlling a control signal for said control valve so that a rotation phase measured by said rotation phase measuring device coincides with a target value;

an amplitude judging device for judging a condition where an amplitude in hunting of said rotation phase is above a predetermined value; and a target value change device for forcibly changing a target value of said rotation phase when said amplitude judging device judges that there is a condition where an amplitude of said rotation phase is above a predetermined value, wherein said target value change device forcibly changes the target value of said rotation phase, when said amplitude is above a predetermined value, and there is a decelerating operating condition of the engine.

13. The apparatus according to any one of claims 10–12, wherein said amplitude judging device comprises:

an oil pressure control condition detection device for detecting an oil pressure control condition where it is predicted that the amplitude in hunting of said rotation phase will go above a predetermined value, wherein when said oil pressure control condition is detected by said oil pressure control condition detection device, said amplitude judging device judges that there is a condition where the amplitude in hunting of said rotation phase is above a predetermined value, and said target value changing device periodically performs a forcible change of said target value.

14. The apparatus according to claim 13, wherein said oil pressure control condition detection device, detects a condition where the oil pressure supplied to said advance angle side hydraulic chamber and delay angle side hydraulic chamber is below a predetermined value, as the oil pressure control condition where it is predicted that the amplitude in hunting of the rotation phase will go above a predetermined value.

15. A method of controlling valve timing of an engine comprising:

a housing connected to a cam sprocket, with recess portions therein; and a rotation member connected to an end portion of a cam shaft and incorporating integrally vanes disposed in said recess portions, and partitioning each of said recess portions by each of said vanes to thereby form advance angle side hydraulic chambers and delay angle side hydraulic chambers at both sides of said respective vanes, the method comprising the steps of:

relatively controlling the supply and discharge of oil pressure to said advance angle side hydraulic chambers and delay angle side hydraulic chambers, using a control valve;

measuring a rotation phase of said cam shaft with respect to a crank shaft;

feedback controlling a control signal for said control valve so that a measured rotation phase coincides with a target value; and computing an offset to be added to said control signal when a feedback control is converged, and when said control signal becomes within a predetermined range, forcibly driving a valve timing apparatus based on said control signal added with said offset.

16. The method according to claim 15, further comprising the step of:

variably setting an offset amount corresponding to a target value of said rotation phase.

17. The method according to claim 15, further comprising the step of:

variably setting an offset amount corresponding to a temperature of operating oil.

18. The apparatus according to claim 17, The method according to claim 15, further comprising the step of:

estimating the temperature of said operating oil corresponding to an engine cooling water temperature.

19. The method according to claim 15, further comprising the step of:

variably setting an offset amount corresponding to an engine rotation speed.

20. The method according to claim 15, further comprising the step of:

variably setting an offset amount corresponding to supply pressure of operating oil.

21. A method of controlling valve timing of an engine comprising:

a housing connected to a cam sprocket, with recess portions therein; and a rotation member connected to an end portion of a cam shaft and incorporating vanes integrally disposed in said recess portions, and partitioning each of said recess portions by each of said vanes to thereby form advance angle side hydraulic chambers and delay angle side hydraulic chambers at both sides of said respective vanes, the method comprising the steps of;

relatively controlling the supply and discharge of oil pressure to said advance angle side hydraulic chambers and delay angle side hydraulic chambers, using a control valve;

measuring a rotation phase of said cam shaft with respect to a crank shaft;

feedback controlling a control signal for said control valve so that a measured rotation phase coincides with a target value;

judging a condition where an amplitude in hunting of said rotation phase is above a predetermined value, using an amplitude judging device; and forcibly changing a target value of said rotation phase when said amplitude judging device judges that there is a condition where an amplitude of said rotation phase is above a predetermined value, wherein the step of judging a condition where an amplitude in hunting of a rotation phase is above a predetermine value further comprises the step of;

computing said amplitude based on a measurement of the rotation phase of said cam shaft with respect to said crank shaft, and judges whether or not the computed amplitude is above a predetermined value.

22. A method of controlling valve timing of an engine comprising:

a housing connected to a cam sprocket, with recess portions therein; and a rotation member connected to an end portion of a cam shaft and incorporating vanes integrally disposed in said recess portions, and partitioning each of said recess portions by each of said vanes to thereby form advance angle side hydraulic chambers and delay angle side hydraulic chambers at both sides of said respective vanes, the method comprising the steps of;

relatively controlling the supply and discharge of oil pressure to said advance angle side hydraulic chambers and delay angle side hydraulic chambers, using a control valve;

measuring a rotation phase of said cam shaft with respect to a crank shaft;

feedback controlling a control signal for said control valve so that a measured rotation phase coincides with a target value;

judging a condition where an amplitude in hunting of said rotation phase is above a predetermined value, using an amplitude judging device;

forcibly changing a target value of said rotation phase when said amplitude judging device judges that there is a condition where an amplitude of said rotation phase is above a predetermined value;

detecting an oil pressure control condition where it is predicted that the amplitude in hunting of said rotation phase will go above a predetermined value;

when said oil pressure control condition is detected by said oil pressure control condition detection device, judging that there is a condition where the amplitude in hunting of said rotation phase is above a predetermined value, and periodically performing a forcible change of said target value, wherein the step of detecting an oil pressure control condition, detects a condition where the temperature of the operating oil is above a predetermined temperature, as the oil pressure control condition where it is predicted that the amplitude in hunting of the rotation phase will go above a predetermined value.

23. The method according to either of claims 21 or 22, further comprising the step of:

forcibly changing the target value of said rotation phase to a maximum advance angle or a maximum delay angle.

24. A method of controlling valve timing of an engine comprising:

a housing connected to a cam sprocket, with recess portions therein; and a rotation member connected to an end portion of a cam shaft and incorporating vanes integrally disposed in said recess portions, and partitioning each of said recess portions by each of said vanes to thereby form advance angle side hydraulic chambers and delay angle side hydraulic chambers at both sides of said respective vanes, the method comprising the steps of;

relatively controlling the supply and discharge of oil pressure to said advance angle side hydraulic chambers and delay angle side hydraulic chambers, using a control valve;

measuring a rotation phase of said cam shaft with respect to a crank shaft;

feedback controlling a control signal for said control valve so that a measured rotation phase coincides with a target value;

judging a condition where an amplitude in hunting of said rotation phase is above a predetermined value, using an amplitude judging device;

forcibly changing a target value of said rotation phase when said amplitude judging device judges that there is a condition where an amplitude of said rotation phase is above a predetermined value and forcibly changing the target value of said rotation phase to either one of a maximum advance angle side and a maximum delay angle side, and then forcibly changing to the other side.

25. A method of controlling valve timing of an engine comprising:

a housing connected to a cam sprocket, with recess portions therein; and a rotation member connected to an end portion of a cam shaft and incorporating vanes integrally disposed in said recess portions, and partitioning each of said recess portions by each of said vanes to thereby form advance angle side hydraulic chambers and delay angle side hydraulic chambers at both sides of said respective vanes, the method comprising the steps of;

relatively controlling the supply and discharge of oil pressure to said advance angle side hydraulic chambers and delay angle side hydraulic chambers, using a control valve;

measuring a rotation phase of said cam shaft with respect to a crank shaft;

feedback controlling a control signal for said control valve so that a measured rotation phase coincides with a target value;

judging a condition where an amplitude in hunting of said rotation phase is above a predetermined value, using an amplitude judging device;

forcibly changing a target value of said rotation phase when said amplitude judging device judges that there is a condition where an amplitude of said rotation phase is above a predetermined value and forcibly changing the target value of said rotation phase, when said amplitude is above a predetermined value, and there is a high load and high rotation speed region of the engine.

26. A method of controlling valve timing of an engine comprising:

a housing connected to a cam sprocket, with recess portions therein; and a rotation member connected to an end portion of a cam shaft and incorporating vanes integrally disposed in said recess portions, and partitioning each of said recess portions by each of said vanes to thereby form advance angle side hydraulic chambers and delay angle side hydraulic chambers at both sides of said respective vanes, the method comprising the steps of;

relatively controlling the supply and discharge of oil pressure to said advance angle side hydraulic chambers and delay angle side hydraulic chambers, using a control valve;

measuring a rotation phase of said cam shaft with respect to a crank shaft;

feedback controlling a control signal for said control valve so that a measured rotation phase coincides with a target value;

judging a condition where an amplitude in hunting of said rotation phase is above a predetermined value, using an amplitude judging device;

forcibly changing a target value of said rotation phase when said amplitude judging device judges that there is a condition where an amplitude, of said rotation phase is above a predetermined value and forcibly changing the target value of said rotation phase, when said amplitude is above a predetermined value, and there is a decelerating operating condition of the engine.

27. The method according to any one of claims 24–26, further comprising the steps of:

detecting an oil pressure control condition where it is predicted that the amplitude in hunting of said rotation phase will go above a predetermined value, when said oil pressure control condition is detected by said oil pressure control condition detection device, judging that there is a condition where the amplitude in hunting of said rotation phase is above a predetermined value, and periodically performing a forcible change of said target value.

28. The method according to claim 27, wherein the step of detecting an oil pressure control condition, detects a condition where the oil pressure supplied to said advance angle side hydraulic chamber and delay angle side hydraulic chamber is below a predetermined value, as the oil pressure control condition where it is predicted that the amplitude in hunting of the rotation phase will go above a predetermined value.

* * * * *